US010624470B2

(12) United States Patent
Smith

(10) Patent No.: US 10,624,470 B2
(45) Date of Patent: Apr. 21, 2020

(54) BAND FOR LOADING CUTLERY

(71) Applicant: JADE GROUP INTERNATIONAL LLC, West Bend, WI (US)

(72) Inventor: Patrick J. Smith, West Bend, WI (US)

( * ) Notice: Subject to any disclaimer, the term of this patent is extended or adjusted under 35 U.S.C. 154(b) by 109 days.

(21) Appl. No.: 16/075,738

(22) PCT Filed: Feb. 10, 2017

(86) PCT No.: PCT/US2017/017292

§ 371 (c)(1),
(2) Date: Aug. 6, 2018

(87) PCT Pub. No.: WO2017/139525

PCT Pub. Date: Aug. 17, 2017

(65) Prior Publication Data

US 2019/0038045 A1 Feb. 7, 2019

Related U.S. Application Data

(60) Provisional application No. 62/293,571, filed on Feb. 10, 2016, provisional application No. 62/364,375, filed on Jul. 20, 2016.

(51) Int. Cl.
*A47F 1/10* (2006.01)
*A47G 21/02* (2006.01)

(52) U.S. Cl.
CPC ..... *A47F 1/10* (2013.01); *A47F 2001/103* (2013.01); *A47G 21/02* (2013.01)

(58) Field of Classification Search
CPC ..... A47F 1/10; A47F 1/00; A47F 1/04; A47F 1/08; A47F 2001/103; A47G 21/00; A47G 21/02; A47G 21/04; A47G 21/06; A47G 21/14; B65D 83/00; B65D 83/08; Y10T 24/44282
See application file for complete search history.

(56) References Cited

U.S. PATENT DOCUMENTS 531,496 A * 12/1894 Barwick ..... B42D 5/005 281/19.1
719,208 A * 1/1903 Garda ..... B26B 11/00 30/143
3,987,901 A * 10/1976 Dullinger ..... B65C 9/10 206/451

(Continued)

FOREIGN PATENT DOCUMENTS

EP 1213985 B1 6/2004

*Primary Examiner* — Ko H Chan
(74) *Attorney, Agent, or Firm* — Shane V. Cortesi

(57) ABSTRACT

A banded cutlery system for loading stacks of plastic cutlery into dispensers is described. The banded cutlery system includes a front tab and a rear tab, and at least one of the front tab and the rear tab comprises a contour that mates with a contour on the adjacent side of the cutlery pieces. The front tab may releasably attach to the rear tab by a fastener that may be located under the stack of cutlery pieces. The front tab may be configured to pivot relative to the rear tab from a locked position in which the front tab is generally parallel to the stack height (and the front and rear tabs are attached by the fastener) to an unlocked position in which the front tab is not parallel the stack height (and the front and rear tabs are not attached by the fastener).

18 Claims, 8 Drawing Sheets

(56) References Cited

U.S. PATENT DOCUMENTS

| | | | | | |
|---|---|---|---|---|---|
| 4,221,352 | A * | 9/1980 | Caveney | H02G 3/32 | 248/74.3 |
| 4,356,599 | A * | 11/1982 | Larson | F16L 3/12 | 24/16 PB |
| 5,231,246 | A * | 7/1993 | Benson | H05K 5/0021 | 174/135 |
| 5,904,250 | A * | 5/1999 | De Schutter | B65D 71/00 | 206/553 |
| 5,937,745 | A * | 8/1999 | Boe | H02G 3/26 | 100/2 |
| 6,336,568 | B1 | 1/2002 | Tucker et al. | | |
| 7,811,614 | B2 * | 10/2010 | Aldridge | B65D 5/5076 | 426/108 |
| 8,152,004 | B2 | 4/2012 | Smith et al. | | |
| 8,210,364 | B2 | 7/2012 | Smith et al. | | |
| 2011/0226797 | A1 * | 9/2011 | Reinsel | A47F 1/10 | 221/97 |

* cited by examiner

BAND FOR LOADING CUTLERY

BACKGROUND

Technical Field

The present disclosure relates to plastic cutlery dispensers accessories, more particularly, to bands for loading stacks of cutlery pieces into plastic cutlery dispensers.

Background of the Invention

Dispensers of plastic cutlery pieces (e.g., knives, spoons, forks and sporks) are well known in the art. U.S. Pat. No. 6,336,568 to Tucker, the entire contents of which are incorporated herein by reference, relates to a cartridge-type dispenser that dispenses cutlery pieces one at a time upon hand via operation of an externally accessible utensil delivery controller. The dispenser includes a housing having at least one interior compartment in communication with an exit opening. At least partially accommodateable within the interior compartment is a stack of cutlery within a cartridge capable of universally accommodating knives or forks or spoons and provided with a portal through which a single piece of cutlery can pass and wherein a dispensable piece of cutlery is situated. The portal is situated in a pathway aligned with the exit opening. Finally, the utensil delivery controller is an externally accessible hand operable ejector engageable with the cutlery and situated for ejecting the cutlery from the portal of the cartridge and thereafter through the pathway to the exit opening for ultimate user retrieval.

Other types of dispensers include dispensers in which the cutlery is loaded in the housing such as U.S. Pat. No. 8,210,364 to Smith, the entire contents of which are incorporated herein by reference. In U.S. Pat. No. 8,210,364 the dispenser generally includes a housing comprising: (a) an actuator, the actuator generally facing in a direction associated with a side of the housing; (b) an opening for loading disposable cutlery; (c) a dispensing chute through which the cutlery passes prior to ejection from the housing; and (d) at least one rocking cam comprising a displacement surface and having a first position and a second position, wherein upon activation of the actuator, the rocking cam moves from the first position to the second position and the displacement surface contacts at least one piece of cutlery, moving the at least one piece of cutlery in a generally lateral direction and toward the dispensing chute, wherein the generally lateral direction is towards the side of the housing in which the actuator is generally facing.

Certain dispensers require reloading the dispensers once all the cutlery is used. Such reloading takes time and, if incorrectly loaded, the dispenser could be prone to jamming. Also, if the person loading the dispenser has not washed her hands prior to loading, the utensils may be unhygienic.

U.S. Pat. No. 8,152,004 to Smith describes a banded packets of disposable cutlery that uses an adhesive.

European Patent No. 1,213,985 to Cassebasse teaches a vertical rod that has one end a grip part and a retaining abutment that holds the top spoon in a stack of spoons in place and at the other end a retaining abutment which holds the bottom spoon in place and the vertical rod is extracted by elastically retracting the elastic retaining projection as the first step in the extraction operation. The vertical rod is inserted through a hole in the stack of spoons.

There is a continuing need for new methods of loading cutlery into dispensers. For example, the system described in European Patent No. 1,213,985 is disadvantageous because it requires a large slot in the cutlery pieces.

BRIEF SUMMARY

A banded cutlery system for loading a stack of cutlery into a cutlery dispenser is described herein. Optionally, the system includes a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side/edge, a rear side/edge comprising a cutlery piece rear side contour, a width extending from the front side to the rear side and generally parallel to the stack width, an eating portion, a handle extending from the eating portion, the handle comprising a handle end, and a piece length extending from the eating portion to the handle end and generally parallel to the stack length; b) a band removably attached to the stack and comprising: i) a front tab comprising a front tab bar comprising a front tab bar top located above the top of the stack, a front tab bar bottom located below the bottom of the stack, a front tab bar height extending from the front tab bar top to the front tab bar bottom, the front tab bar height generally parallel to the stack height, a front tab bar left side, a front tab bar right side, a front tab bar length extending from the front tab bar left side to the front tab bar right side and generally parallel to the stack height, the front tab bar extending along the stack height and confronting the front sides of the cutlery pieces as the front tab bar extends along the stack height, a front tab top lateral extension extending from the front tab bar generally perpendicular to the front tab height, and a front tab bottom lateral extension extending from the front tab bar generally perpendicular to the front tab height and located directly below the bottom of the stack, the bottom lateral extension supporting the bottom of the stack; iii) a rear tab comprising a rear tab bar comprising a rear tab bar top located above the top of the stack, a rear tab bar bottom located below the bottom of the stack, a rear tab bar height extending from the rear tab bar top to the rear tab bar bottom, the rear tab bar height generally parallel to the stack height, the rear tab bar extending along the stack height and confronting the rear sides of the cutlery pieces as the rear tab bar extends along the stack height, and a rear tab top lateral extension extending from the rear tab bar generally perpendicular to the rear tab height and located directly above the top of the stack; and iv) a fastener removably connecting the front tab bottom lateral extension to the rear tab bar, wherein the rear tab comprises a permanent rear tab contour extending along the cutlery stack height and mating with at least a portion of the cutlery piece rear side contour of each cutlery piece, said mating configured to prevent said cutlery pieces from moving in a direction parallel to the cutlery piece length and the rear tab bar length, and further wherein the cutlery piece rear side contour of each cutlery piece are generally aligned along the stack height.

Optionally, the cutlery piece rear side contour comprises a recess and the rear tab contour mates with the recess. Optionally, the rear tab contour comprises a recess and the cutlery piece rear side contour mates with the recess. Optionally, the rear tab contour comprises a groove and the cutlery piece rear side contour mates with the groove. Optionally, the cutlery piece rear side contour is located in the handle of each cutlery piece. Optionally, the cutlery piece rear side contour is located in a segment of the handle of the cutlery pieces, the segment having a variable width, and further wherein the segment comprises a proximal end located a first distance from the eating portion, a distal end located a second distance from the eating portion, the second distance greater than the first distance, and an intermediate portion located between the proximal end and the distal end and further wherein the segment width gradually increases from the proximal end to the intermediate portion and further wherein the segment width gradually decreases from the intermediate portion to the distal end. In other words, the intermediate portion may bulge outward to create an apex. Optionally, the cutlery piece rear side contour is located in a segment of the handles of the cutlery pieces, the segment having a variable width, and further wherein the segment comprises a proximal end located a first distance from the eating portion, a distal end located a second distance from the eating portion, the second distance greater than the first distance, and an intermediate portion located between the proximal end and the distal end and further wherein the segment width gradually decreases from the proximal end to the intermediate portion and further wherein the segment width gradually increases from the intermediate portion to the distal end. Optionally, the front side/edge of each cutlery pieces comprises a cutlery piece front side contour, wherein the front tab comprises a front tab contour extending along the cutlery stack height and mating with at least a portion of the cutlery piece front side contour, said mating configured to prevent said cutlery pieces from moving in a direction parallel to the cutlery piece length and the rear tab bar length, and further wherein the cutlery piece front side contour of each cutlery piece are generally aligned along the stack height. Optionally, the cutlery piece front side contour is a mirror image of the cutlery piece rear side contour and the cutlery pieces are generally symmetrical about the cutlery piece length/longitudinal axis. Optionally, the front tab is configured to pivot along a front tab pivot axis to an unlocked position in which the front tab bottom lateral extension is disconnected from the rear tab bar, in which the front tab bottom lateral extension is not below the stack, in which the front tab bottom lateral extension is in front of the stack and further in which the front tab bar height is not parallel to the stack height. Optionally, the system further comprises a recess opposite (i.e., directly below) the at least one pivot axis and facing the stack top. Optionally, the at least one pivot axis is a hinge. Optionally, the system further includes a handle tab comprising a handle tab base connected to the front tab and the rear tab and a handle tab apex. Optionally, the rear tab is configured to pivot along a rear tab pivot axis to an unlocked position in which the front tab bottom lateral extension is disconnected from the rear tab bar, and further in which the rear tab bar height is not parallel to the stack height. Optionally, the fastener comprises a prong located in the front tab bottom lateral extension and a hole in the rear tab bar configured to removably receive the prong. Optionally, the front tab bar bottom extends below the front tab bar bottom lateral extension and below the bottom of the stack. Optionally, the band is plastic. Optionally, the rear tab further comprises a rear tab bottom lateral extension extending from the rear tab bar generally perpendicular to the rear tab height and located directly below the bottom of the stack, the rear tab bottom lateral extension supporting the bottom of the stack, wherein the front tab bottom lateral extension comprises a front tab bottom lateral extension hole extending through the front tab bottom lateral extension, wherein the rear tab bottom lateral extension comprises a rear tab bottom lateral extension hole extending through the rear tab bottom lateral extension, each bottom lateral extension hole having a hole length generally parallel to the stack length, a hole width generally parallel to the stack width and a hole height generally parallel to the stack height, wherein the banded cutlery system further comprises a removable pull pin having a proximal end, a distal end, and a pull pin length extending from the proximal end to the distal end and generally parallel to the stack length, and further wherein the pull pin and the front tab bottom lateral extension hole and the rear tab bottom lateral extension hole form the fastener. Optionally, the pull pin further comprises a pull pin handle (e.g., a ring) adjacent to the pull pin proximal end and further wherein the pull pin length extends beyond the cutlery stack length. Optionally, the pull pin comprises a proximal flange located between the bottom lateral extensions and the pull pin handle, and a distal flange located distal to the proximal flange and located between the distal end of the pull pin and the bottom lateral extensions, wherein the proximal flange has a proximal flange width generally parallel to the widths of the bottom lateral extension holes and a height generally parallel to the heights of the bottom lateral extension holes, and further wherein at least one of i) the proximal flange width is greater than the widths of the bottom lateral extension holes; and ii) the proximal flange height is greater than the heights of the bottom lateral extension holes. Optionally, the pull pin distal flange includes at least one slot and further wherein the pull pin distal flange has a pull pin distal flange width generally parallel to the width of the bottom lateral extension holes, and further wherein the pull pin distal flange has an expanded state wherein the pull pin distal flange width is greater than the width of the holes in the front tab and rear tab bottom lateral extension holes and a collapsed state in which the pull pin distal flange width is less than the width of the holes in the front tab and rear tab bottom lateral extension holes and further wherein the pull pin distal flange is able to move through the front tab and rear tab bottom lateral extension holes when the pull pin distal flange is in the collapsed state and further wherein the pull pin distal flange is unable to move through the front tab and rear tab bottom lateral extension holes when the pull pin distal flange is in the expanded state. Optionally, the pull pin distal flange includes at least one slot and further wherein the pull pin distal flange has a pull pin distal flange height generally parallel to the height of the bottom lateral extension holes, and further wherein the pull pin distal flange has an expanded state wherein the pull pin distal flange height is greater than the height of the front tab and rear tab bottom lateral extension holes and a collapsed state in which the pull pin distal flange height is less than the height of the front tab and rear tab bottom lateral extension holes and further wherein the pull pin distal flange is able to move through the front tab and rear tab bottom lateral extension holes when the pull pin distal flange is in the collapsed state and further wherein the pull pin distal flange is unable to move through the front tab and rear tab bottom lateral extension holes when the pull pin distal flange is in the expanded state. Optionally, at least one of the front tab and the rear tab comprises two bottom lateral extensions, the pull pin is inserted through the holes in all of the bottom lateral extensions and further wherein the bottom lateral extensions interlock. (e.g., if front tab has two bottom lateral extensions, the rear tab bottom lateral extension is located between the front tab bottom lateral extensions). Optionally, the proximal flange is generally cylindrical in shape. Optionally, the distal flange is tapered. Optionally, the front tab is configured to pivot along a front tab pivot axis to a front tab unlocked position in which the front tab bottom lateral extension is disconnected from the rear tab bottom lateral extension, in which the front tab bottom lateral extension is not below the stack, in which the front tab bottom lateral extension is in front of the stack and further in which the front tab bar height is not parallel to the stack height. (The rear tab may similarly pivot). Optionally, the system is used in a method of loading a cutlery dispenser that includes: a) providing a cutlery dispenser (can be dispenser itself or cartridge); b) loading the banded cutlery system into the cutlery dispenser; c) removing the pull pin from the front tab and rear tab bottom lateral extension holes; d) pivoting the front tab about the front tab pivot axis; and e) removing the front tab and the rear tab without removing the cutlery stack from the cutlery dispenser.

In other embodiments, the front tab includes a contour and the cutlery piece front side also includes a contour. More particularly, the system may include: a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side/edge comprising a cutlery piece front side contour, a rear side/edge, a width extending from the front side to the rear side and generally parallel to the stack width, an eating portion, a handle extending from the eating portion, the handle comprising a handle end, and a piece length extending from the eating portion to the handle end and generally parallel to the stack length; b) a band removably attached to the stack and comprising: i) a front tab comprising a front tab bar comprising a front tab bar top located above the top of the stack, a front tab bar bottom located below the bottom of the stack, a front tab bar height extending from the front tab bar top to the front tab bar bottom, the front tab bar height generally parallel to the stack height, a front tab bar left side, a front tab bar right side, a front tab bar length extending from the front tab bar left side to the front tab bar right side and generally parallel to the stack height, the front tab bar extending along the stack height and confronting the front sides of the cutlery pieces as the front tab bar extends along the stack height, a front tab top lateral extension extending from the front tab bar generally perpendicular to the front tab height, and a front tab bottom lateral extension extending from the front tab bar generally perpendicular to the front tab height and located directly below the bottom of the stack, the bottom lateral extension supporting the bottom of the stack; iii) a rear tab comprising a rear tab bar comprising a rear tab bar top located above the top of the stack, a rear tab bar bottom located below the bottom of the stack, a rear tab bar height extending from the rear tab bar top to the rear tab bar bottom, the rear tab bar height generally parallel to the stack height, the rear tab bar extending along the stack height and confronting the rear sides of the cutlery pieces as the rear tab bar extends along the stack height, and a rear tab top lateral extension extending from the rear tab bar generally perpendicular to the rear tab height and located directly above the top of the stack; and iv) a fastener removably connecting the front tab bottom lateral extension to the rear tab bar, wherein the front tab comprises a permanent front tab contour extending along the cutlery stack height and mating with at least a portion the cutlery piece front side contour of each cutlery piece, said mating configured to prevent said cutlery pieces from moving in a direction parallel to the cutlery piece length and the front tab bar length, and further wherein the cutlery piece front side contour of each cutlery piece are generally aligned along the stack height.

In such embodiments, the rear tab and the cutlery piece rear side may also include contours. In addition, the cutlery pieces and the front and rear tabs may have the features described above, including without limitation, the hinging mechanism, and the fasteners.

BRIEF DESCRIPTION OF THE DRAWINGS

in FIG. 1, the front tab is in the locked position.

in FIG. 2, the front tab is in the locked position.

in FIG. 3, the front tab is in the locked position.

in FIG. 4, the front tab is in the locked position.

in FIG. 5, the front tab is in the locked position.

in FIG. 6, the front tab is in the locked position.

in FIG. 7, the front tab is in the locked position.

in FIG. 8, the front tab is in the locked position.

in FIG. 9, the front tab is in the locked position.

in FIG. 11, the front tab is in the locked position.

in FIG. 14, the front tab is in the unlocked position.

in FIG. 15, the front tab is in the locked position and the system includes a pull pin to connect the front tab bottom lateral extensions to the rear tab bottom lateral extension.

in FIG. 16, the front tab is in the locked position.

in FIG. 17, the front tab is in the unlocked position.

in FIG. 20, the front tab is in the locked position.

in FIG. 21 the front tab is in the locked position.

DETAILED DESCRIPTION

Figure 1:
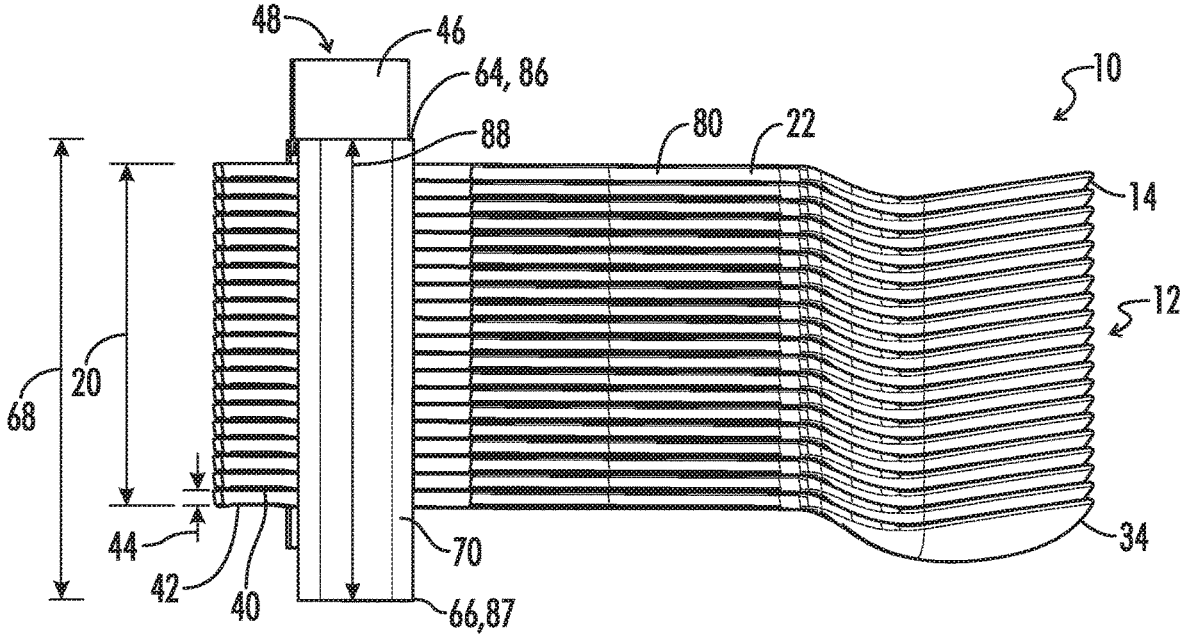
FIG. 1 illustrates a front elevation of one embodiment of the banded cutlery system of the present invention.

Referring to FIGS. 1-14, the present disclosure provides a banded cutlery system generally designated by the numeral 10. In the drawings, not all reference numbers are included in each drawing for the sake of clarity.

Referring to FIGS. 1-14, the banded cutlery system 10 includes a stack 12 of pieces of cutlery 14. The stack 12 has a top 16, a bottom 18, a height 20 extending from the top 16 to the bottom 18, a front side 22, a rear side 24, a width 26 extending from the front side 22 to the rear side 24 and generally perpendicular to the height 20, a left side 28, a right side 30, and a length 32 extending from the left side 28 to the right side 30 and generally perpendicular to the width 26 and the height 20. Each piece of cutlery 14 has a top 40, a bottom 42, a height 44 from extending the top 40 to the bottom 42 and generally parallel to the stack height 20, a front side 80, a rear side 82, a width 84 extending from the front side 80 to the rear side 82 and generally parallel to the stack width 26, an eating portion 34 and a handle 36 extending from the eating portion 34 and comprising a handle end 108 and a length 101 extending from the eating portion 34 to the handle end 108. (The eating portion 34 is also referred to in the art as the food contact portion of the cutlery such as the serrations of a knife, the tines of a fork, and the bowl of a spoon).

The banded cutlery system 10 further includes a band 48 removably attached to the stack 12 and comprising a front tab 62 attached to, and preferably rotatable relative to, a rear tab 55. The banded cutlery system may further include a handle tab 46 comprising a base 50, an apex 52, which may or may not be rounded, and a height 54 extending from the base 50 to the apex 52. The handle tab 46 may include an aperture (not shown) for gripping.

The rear tab 55 has a top 56, a bottom 58, and a height 60 extending from the top 56 to the bottom 58. More particularly, when the rear tab 55 is in the rear tab locked position (which is described below) the rear tab 55 may include a rear tab bar 90 comprising a rear tab bar top 92 located above the top 16 of the stack 12, a rear tab bar bottom 94 located below the bottom 18 of the stack 12, and a rear tab bar height 96 generally parallel to the stack height 20, the rear tab bar 90 extends along the stack height 22 and contacts, preferably engages, the rear sides 82 of the cutlery pieces 14 as the rear tab 90 extends along the stack height 20. When the rear tab 55 is in the rear tab locked position, the rear tab 55 may further include a rear tab top lateral extension 98 extending from the rear tab bar 90 generally perpendicular to the rear tab bar height 96 and located directly above the top 16 of the stack 12. Optionally, the rear tab 55 may be pivotably attached to a handle base 50 or a front tab lateral extension 72 (described below) along a rear tab pivot axis 100 and configured to pivot from a rear tab locked position in which the rear tab bar height 96 is generally parallel to the stack height 20 and in which a lower segment of the rear tab bar 90 (i.e., a segment adjacent to the rear tab bar bottom 92) is connected to the front tab 62 via fastener 74 (described below) to a rear tab unlocked position in which the rear tab bar height 96 is not parallel to the stack height 20 (i.e., between about 10 degrees and 180 degrees, more preferably between about 30 and 180 degrees, more preferably generally perpendicular to the stack height 20) and in which the lower segment of the rear tab bar 90 is not connected to the front tab 62.

Figure 2:
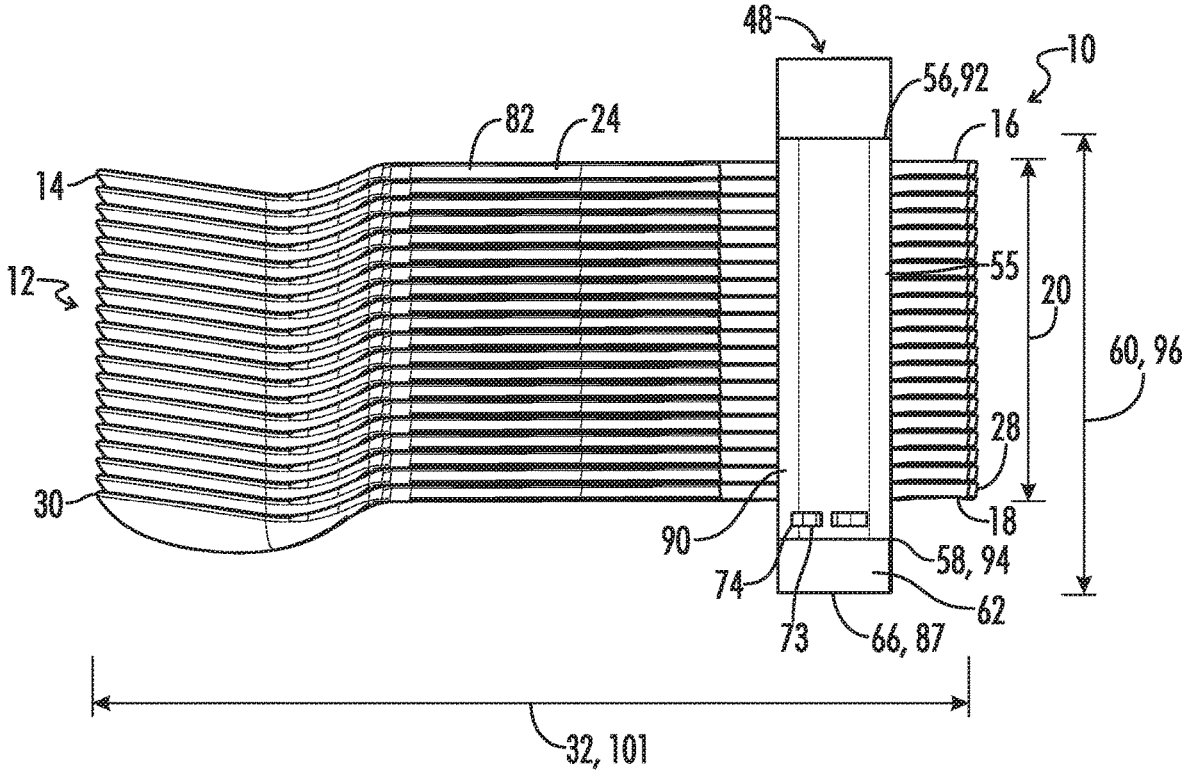
FIG. 2 illustrates a rear elevation view of the banded cutlery system of FIG. 1.
Figure 3:
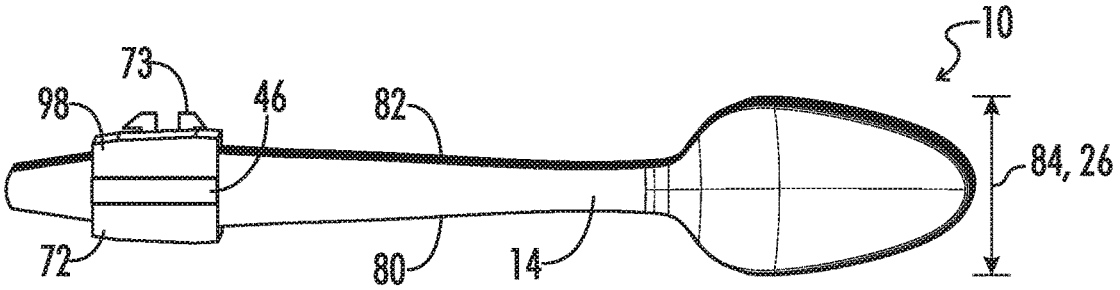
FIG. 3 illustrates a top, perspective view of the banded cutlery system of FIG. 1.
Figure 4:
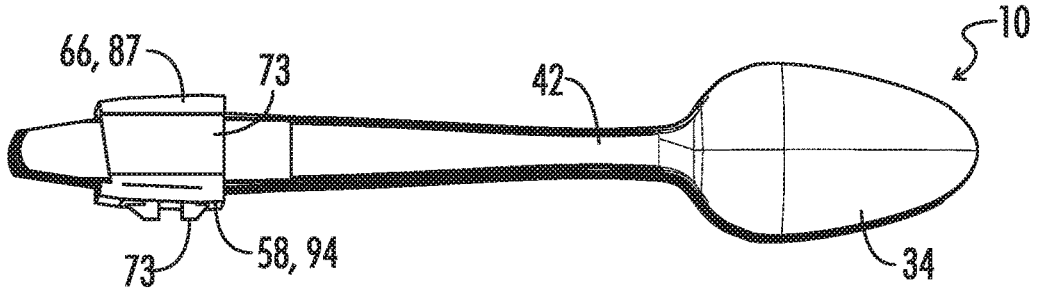
FIG. 4 illustrates a bottom, perspective view of the banded cutlery system of FIG. 1.
Figure 5:
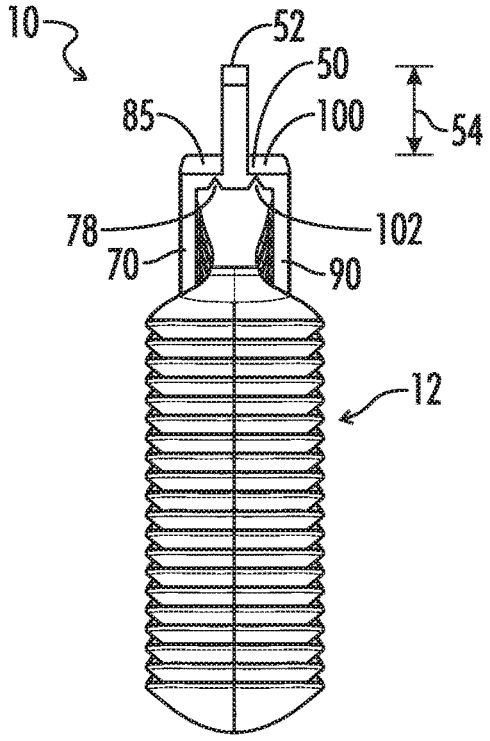
FIG. 5 illustrates a left side perspective view of the banded cutlery system of FIG. 1.
Figure 6:
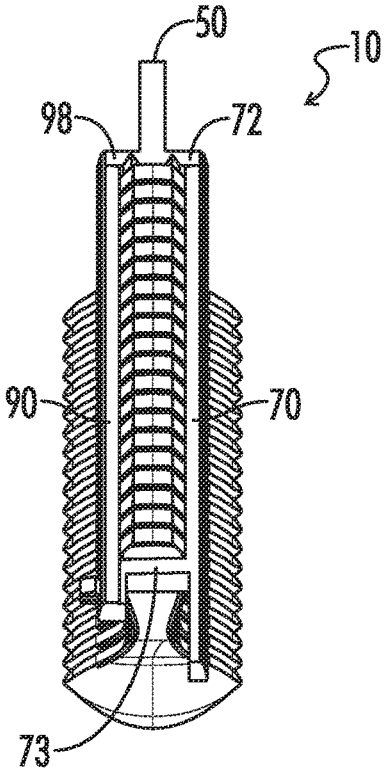
FIG. 6 illustrates a right side perspective view of the banded cutlery system of FIG. 1.

The front tab 62 may be configured to pivot between a front tab locked position, as shown in FIGS. 1-8, in which the front tab 62 is oriented generally parallel to the stack height 20 and an unlocked position, in which the front tab 62 is oriented not parallel to the stack height 20 (i.e., between about 10 degrees and 180 degrees, more preferably between about 30 and about 180 degrees, more preferably generally perpendicular to the stack height 20). When the front tab 62 is in the front tab locked position, the front tab 62 has a top 64 above the top 16 of the stack 12 (as best seen in FIGS. 2-3), a bottom 66 located below the bottom 18 of the stack 12 (as best seen in FIG. 4), and a height 68 extending from the top 64 to the bottom 66 and generally parallel to the stack height 20. More particularly, in some embodiments, when the front tab 62 is in the locked position, the front tab 62 includes a front tab bar 70 that has a front tab bar top 86 located above the top 16 of the stack 12, a front tab bar bottom 87 located below the bottom 18 of the stack 12, a front tab bar height 88 extending from the front tab bar top 86 to the front tab bar bottom 87, the front tab bar 70 extending along the stack height 20 and confronting, preferably engaging, the front side 80 of each piece of cutlery 14 as the front tab bar 70 extends along the stack height 20. When the front tab 62 is in the locked position, the front tab 62 further includes a top lateral extension 72 that extends from the front tab bar 70 generally perpendicular to the front tab height 68 and front tab bar height 88 and is located directly above the top 16 of the stack 20 (i.e., directly above the top cutlery piece) (as best seen in FIGS. 5-6), and a bottom lateral extension 73 that extends from the front tab bar 70 generally perpendicular to the front tab height 68 and front tab bar height 88 and is located directly below the bottom 18 of the stack 12 (i.e., directly below the bottom cutlery piece). When the front tab 62 is in the locked position, the bottom lateral extension 73 supports the bottom of the stack 12 and includes a fastener 74 configured to removably receive the rear tab 55 when the front tab 62 is in the locked position. Any suitable fastener may be used. For example, in the illustrated embodiments of FIGS. 1-14, the rear tab 55 includes a hole configured to receive prong(s) of the front tab bottom lateral extension 73 (e.g., two prongs separate by a groove), which may be suitable if the rear tab 55 and the front tab 62 are made out of plastic for example. In the illustrated embodiment, the top lateral extension 72 is attached to the handle tab 46 via a living hinge 85 located at the interface of the front tab top lateral extension 72 and the handle tab base 50, which again, may be advantageous if the handle tab 46 and the front tab 62 are plastic. In the illustrated embodiment of FIGS. 1-14, as best seen in FIGS. 5-6, the front tab top lateral extension 72 and the handle tab base 50 form a first wedge-shaped recess 78, which creates a weakness in the plastic (and hence a first living hinge 85) directly above the first wedge-shaped recess 78, and the rear tab top lateral extension 98 and the handle tab base 50 form a second wedge-shaped recess 102, which creates a weakness in the plastic (and hence a second living hinge 100) directly above the second wedge-shaped recess 102.

The dual hinges 85 and 100, which allow for pivoting of the front and rear tabs 62 and 55 is advantageous in that the cutlery dispenser may be loaded from either the front or rear sides.

The front tab bar height 88 may be greater than the rear tab bar height 96, as seen in FIG. 2 for example.

Figure 11:
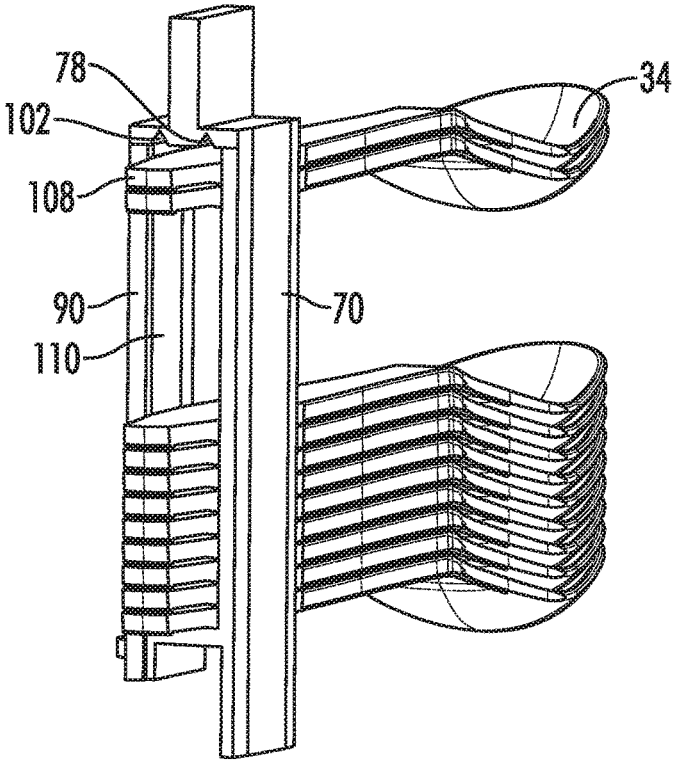
FIG. 11 illustrates a rear perspective view of the banded cutlery system of FIG. 1 with some of the cutlery pieces removed.

At least one of the front tab 62 and the rear tab 55 includes a contour (rear tab contour is designated by the numeral 110; front tab contour is not specifically shown but is similar to, and may be a mirror image of, rear tab contour) that mates with a contour on the pieces of cutlery 14 that prevents movement of the cutlery pieces 14 parallel to the stack length 32. For example, the front side/edge 80 of each piece of cutlery 14 may include a cutlery piece front side contour 104 (preferably located in the handle 36) that mates with a contour (not shown) located in the front tab 62 (more particularly located in the front tab bar 70), and/or the rear side/edge 82 of each piece of cutlery 14 may comprise a cutlery piece rear side contour 106 preferably located in the handle 36 that mates with a contour 110 located in the rear tab 55 (more particularly the rear tab bar 90), as best seen in FIG. 11. The contours 110 in the front and rear tabs 62 and 55 are preferably permanent—meaning that the front and rear tabs 62 and 55 do not bend when placed in contact with the cutlery pieces 14. Thus, the front and rear tabs 62 and 55 are preferably rigid. The contour (not shown) in the front tab 62 has a mating shape as the contour 104 in the cutlery piece front side 80 and similarly the contour 110 in the rear tab 55 has a mating shape as the contour 106 in the cutlery piece rear side 82. The front tab contour (not shown) is preferably formed in the interior surface of the front tab bar 70 (i.e., the surface of the front tab bar 70 facing the cutlery piece front side 80) and the rear tab contour 110 is preferably formed in the interior surface of the rear tab bar 90 (i.e., the surface of the rear tab bar 90 facing the cutlery piece rear side 82). In exemplary embodiments, the rear tab contour 110 may be a recess or groove that extends the stack height 20 and the cutlery piece rear side contour 106 may be a protrusion, as shown in FIG. 11. Alternatively, the rear tab contour 110 may be a protrusion that extends the stack height 20 and the rear sides 82 of the cutlery pieces 14 may be a recess or groove. These same mating options are available for the front tab contour and the cutlery piece front side contour 104.

Figure 10:
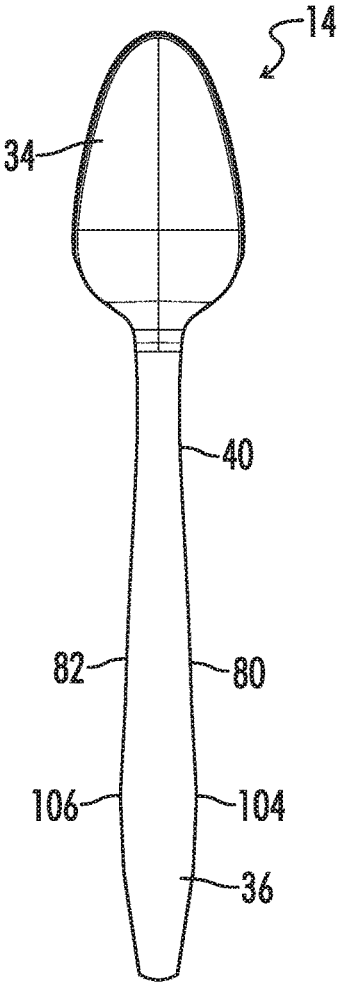
FIG. 10 illustrates a top plan view of a cutlery piece of the banded cutlery system of FIG. 1.
Figure 12:
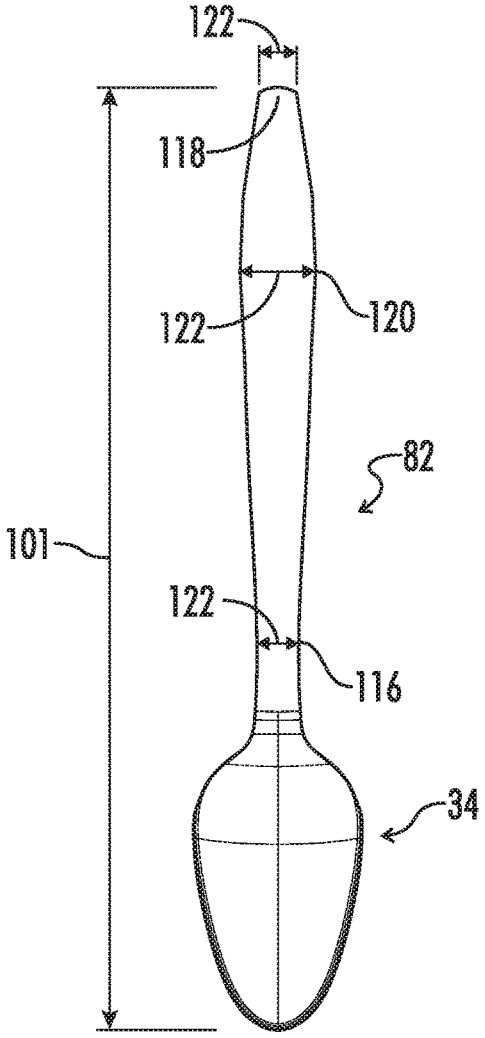
FIG. 12 illustrates another top plan view of a cutlery piece of the banded cutlery system of FIG. 1.
Figure 13:
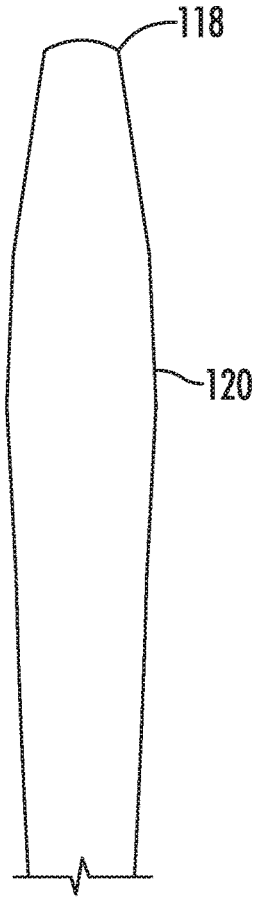
FIG. 13 illustrates a closeup top plan view of a portion of the cutlery piece of FIG. 12.
Figure 14:
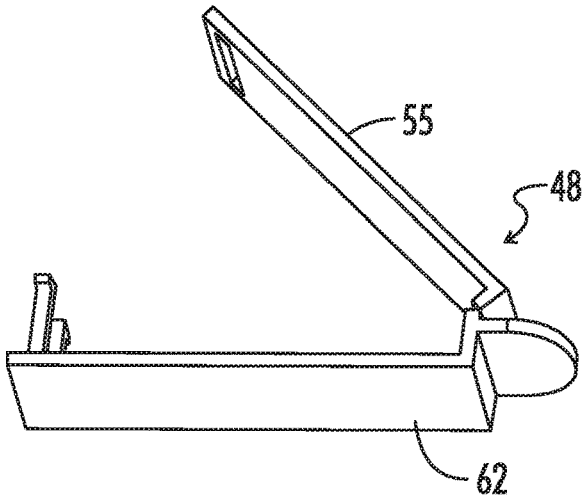
FIG. 14 illustrates a rear perspective view of another embodiment of a banded cutlery system.

The cutlery piece front and rear side contours 104 and 106 optionally extend outward (i.e., create a bulge), as shown in FIGS. 10 and 12-13, or inward. The contours 104 and 106 may be very subtle as shown in FIGS. 10 and 12-13, and the front tab contour and rear tab contour 110 may mate with only a portion of the cutlery piece front and rear side contours 104 and 106.

More particularly, optionally, the cutlery piece rear side contour 106 is located in a segment 112 of the handle 36 of each cutlery piece 14, the segment 112 having a variable width 122, and further wherein the segment 112 comprises a proximal end 116 located a first distance from the eating portion 34, a distal end 118 located a second distance from the eating portion 34, the second distance greater than the first distance, and an intermediate portion 120 located between the proximal end 116 and the distal end 118 and further wherein the segment width 122 gradually increases from the proximal end 116 to the intermediate portion 120 and further wherein the segment width 122 gradually decreases/tapers from the intermediate portion 120 to the distal end 118, as shown in FIGS. 12-13. Alternatively, the segment width 122 may gradually decrease/taper from the proximal end 116 to the intermediate portion 120 and further wherein the segment width 122 gradually increases from the intermediate portion 120 to the distal end 118. The cutlery piece front side contour 104 may be similarly shaped. Optionally, the cutlery piece front side and rear side contours 104 and 106 are mirror images of each other so that the cutlery piece 14 is symmetrical about the cutlery piece length 101 (as measured from the eating portion 34 to the handle end 108), as shown in FIGS. 10 and 12-13.

Figure 7:
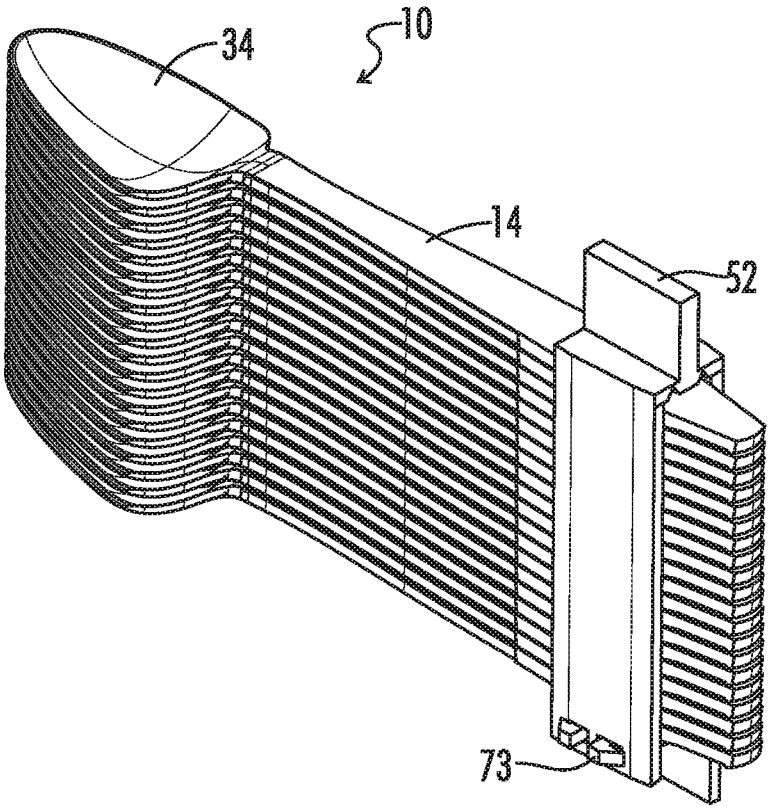
FIG. 7 illustrates a rear perspective view of the banded cutlery system of FIG. 1.
Figure 8:
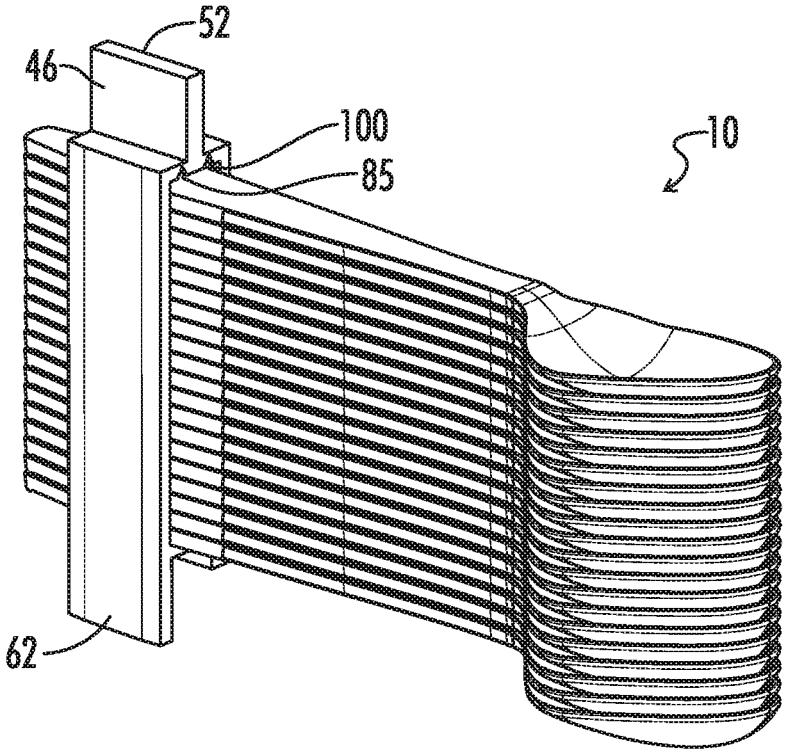
FIG. 8 illustrates a front perspective view of the banded cutlery system of FIG. 1.
Figure 9:
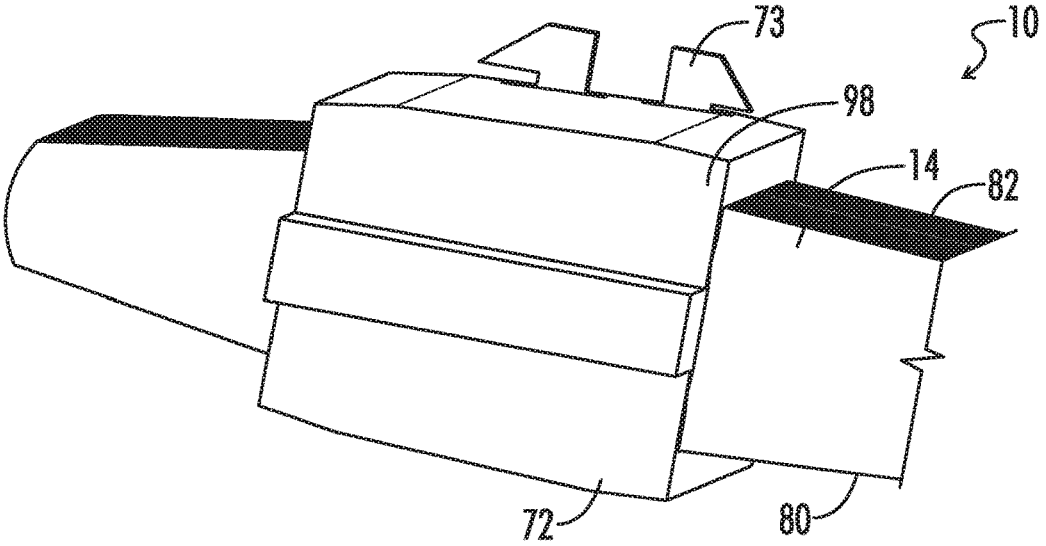
FIG. 9 illustrates a top perspective view of the banded cutlery system of FIG. 1.

Optionally, the front tab contour and the rear tab contour 110 cover at least the recess of the cutlery piece rear side contour or, as best seen in FIGS. 3, 7 and 9, the apex of the protrusion of the cutlery piece rear side contour To load the banded cutlery system 10 in a cutlery dispenser, the system 10 is provided with the front tab 62 and the rear tab 55 in the locked position and the user holds the system 10 by the handle tab 46 and the front tab 62. After loading into a dispenser, the user removes the band 48 by pulling the front tab 62 forwardly (i.e., toward the user) to disengage the front tab 62 from the rear tab 55 and causing the front tab 62 to pivot along the front tab pivot axis/hinge 85 from the front tab locked position to the front tab unlocked position. The user then pulls the band 48 vertically upwardly.

The Embodiments of FIGS. 15-21

FIGS. 15-21 provide an alternate design of a band 48. It will be understood that the system 10 of FIGS. 15-21 is generally the same as the system 10 of FIGS. 1-14 (e.g., both systems may include the aforementioned handle tab 46, front and rear tabs 62 and 55 with hinges/pivot axes 85 and 100, the front tab contour and rear tab contour 110 and the stack 12 of cutlery pieces 14). The principle difference is that the system 10 of FIGS. 15-21 uses a quick release fastener (namely a removable pull pin 210) as described below that is positioned inside holes 202 and 209 in the front tab bottom lateral extension 73 and the rear tab bottom lateral extension 208 when the front tab 62 is in the front tab locked position and the rear tab 55 is in the rear tab locked position.

More particularly, with reference to FIGS. 15-21, the rear tab 55 may further comprise a rear tab bottom lateral extension 208 extending from the rear tab bar 90 generally perpendicular to the rear tab height 60 and located directly below the bottom 18 of the stack 12, the rear tab bottom lateral extension 208 supporting the bottom 18 of the stack 12. The front tab bottom lateral extension 73 may comprise a front tab bottom lateral extension hole 202 extending through the front tab bottom lateral extension 73. The rear tab bottom lateral extension 208 may comprise a rear tab bottom lateral extension hole 209 extending through the rear tab bottom lateral extension 208. Each of the front tab and the rear tab bottom lateral extension holes 202 and 209 may have a hole length (the rear tab bottom lateral extension hole length is labelled in the drawings as 217; the front tab bottom lateral extension hole length is not labelled) generally parallel to the stack length 32, a hole width (the rear tab bottom lateral extension hole width is labelled as 211; the front tab bottom lateral extension hole width is not labelled) generally parallel to the stack width 26 and a hole height (the rear tab bottom lateral extension hole height is labelled as 215; the front tab bottom lateral extension hole height is not labelled) generally parallel to the stack height 20. The banded cutlery system 10 may further comprise a removable pull pin 210 having a proximal end 212, a distal end 214, and a pull pin length 216 extending from the proximal end 212 to the distal end 214 and generally parallel to the stack length 32, and further wherein the pull pin 210 and the front tab bottom lateral extension hole 202 and the rear tab bottom lateral extension hole 209 form the fastener.

Figure 15:
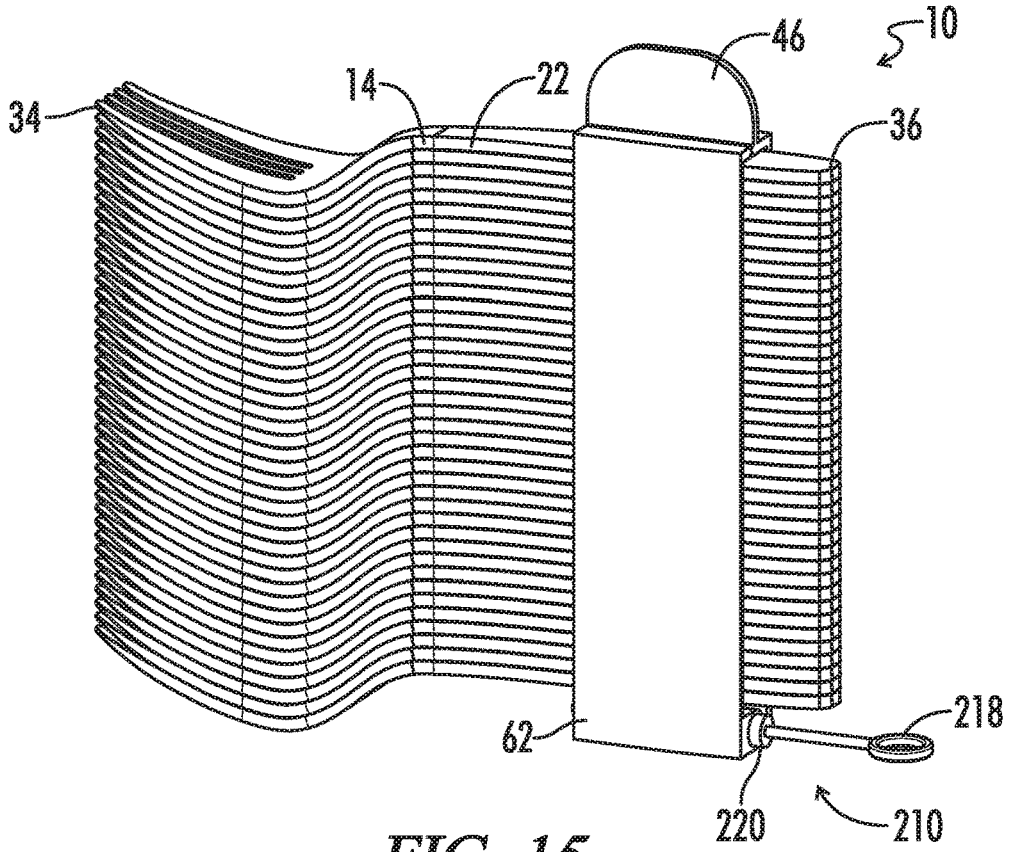
FIG. 15 illustrates a front perspective view of another embodiment of a banded cutlery system.
Figure 16:
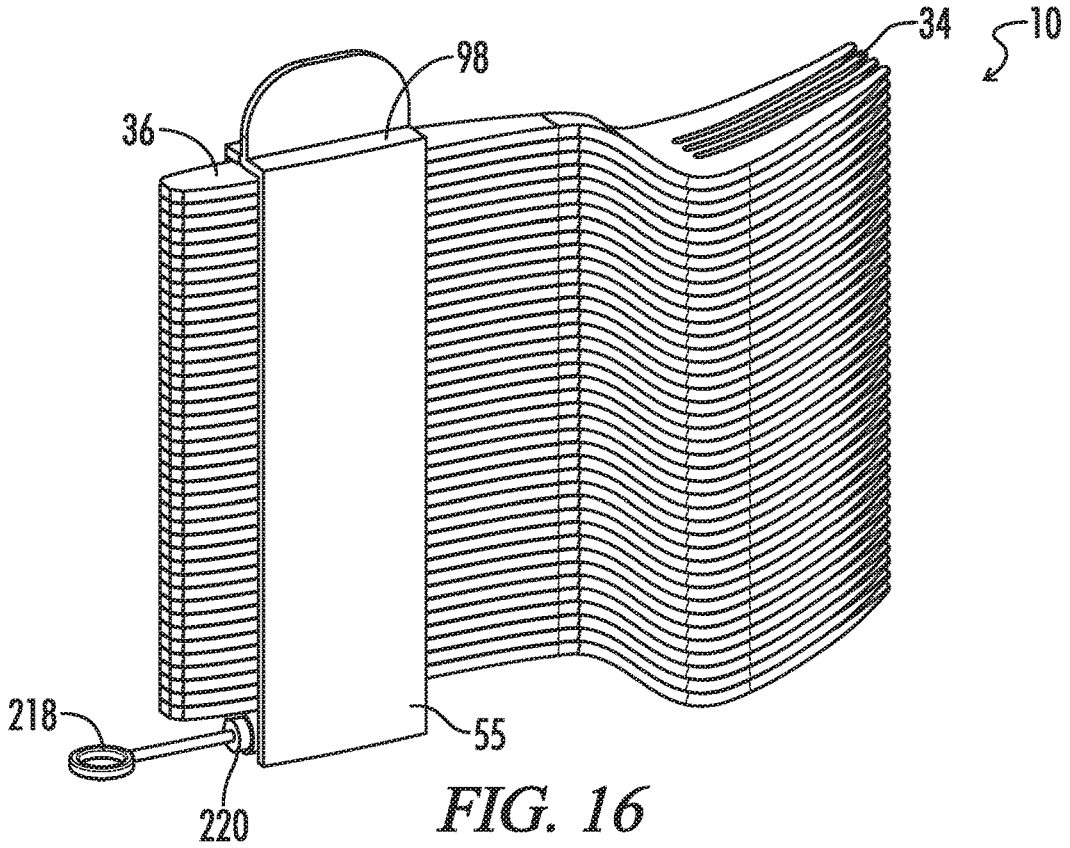
FIG. 16 illustrates a rear perspective view of the banded cutlery system of FIG. 15.

Optionally, the pull pin 210 further comprises a pull pin handle 218 (e.g., a ring) adjacent to the pull pin proximal end 212 and the pull pin length 216 extends beyond the cutlery stack length 32 (e.g., beyond the cutlery piece handle 36), as best seen in FIG. 15. Optionally, the pull pin 210 comprises a proximal flange 220 located between the bottom lateral extensions 73 and 208 and the pull pin handle 218. Optionally, the pull pin 210 further includes a distal flange 226 located distal to the proximal flange 220 and located between the distal end 214 of the pull pin 210 and the bottom lateral extensions 73 and 208. Optionally, the proximal flange 220 has a proximal flange width 222 generally parallel to the widths of the bottom lateral extension holes (again only width 211 is labelled) and a height 224 generally parallel to the heights of the bottom lateral extension holes (again only height 215 is shown), and at least one of i) the proximal flange width 222 is greater than the widths of the front tab and rear tab bottom lateral extension holes (again only width 211 is labelled); and ii) the proximal flange height 224 is greater than the heights of the bottom lateral extension holes (again only 215 is labelled) so that the proximal flange 222 acts as a stop as best seen in FIG. 15. It will be appreciated that the aforementioned assumes that the front tab and rear tab bottom lateral extension holes are generally the same size. If this is not the case, the proximal flange 220 need only be bigger than the proximal-most of the front tab and rear tab bottom lateral extension holes.

Figure 19:
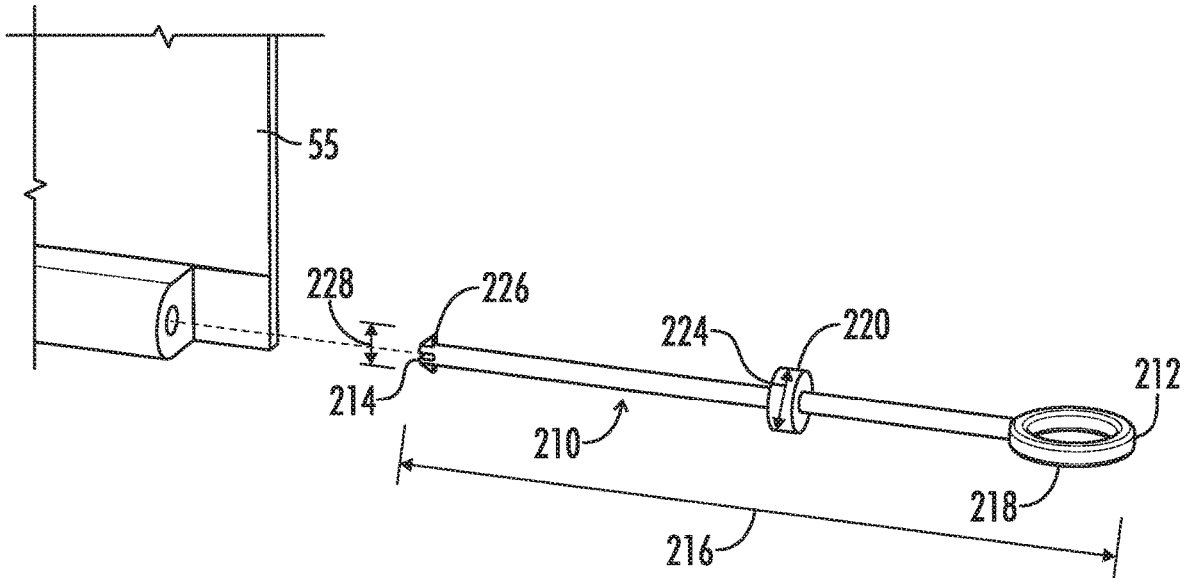
FIG. 19 illustrates a close-up front perspective view of the pull pin and the rear tab of the band of FIG. 17.
Figure 20:
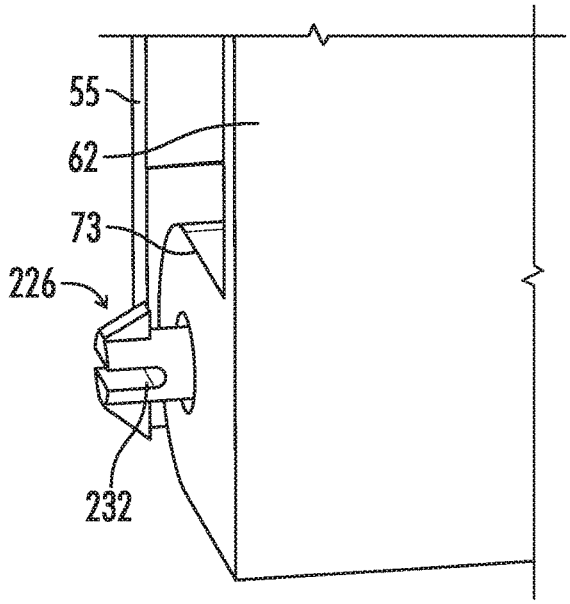
FIG. 20 illustrates another closeup front perspective view of the band of the banded cutlery system of FIG. 15.
Figure 21:
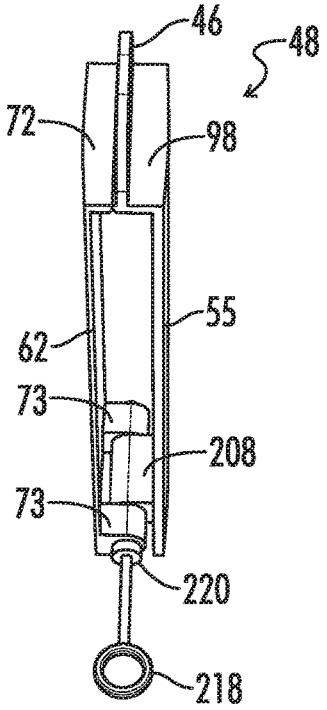
FIG. 21 illustrates a side perspective view of the band of the banded cutlery system of FIG. 15.

Optionally, the pull pin distal flange 226 includes at least one slot 232 and further the pull pin distal flange 226 has a pull pin distal flange width (not labelled) generally parallel to the width of the bottom lateral extension holes (again only width 211 is labelled), and the pull pin distal flange 226 has an expanded state wherein the pull pin distal flange width is greater than the width of the holes in the front tab and rear tab bottom lateral extension holes 211 and a collapsed state in which the pull pin distal flange width is less than the width of the holes in the front tab and rear tab bottom lateral extension holes 211. In such a case, the pull pin distal flange 226 is able to move through the front tab and rear tab bottom lateral extension holes 202 and 209 when the pull pin distal flange is in the collapsed state and the pull pin distal flange 226 is unable to move through the front tab and rear tab bottom lateral extension holes 202 and 209 when the pull pin distal flange 226 is in the expanded state (which the pull pin flange 226 occupies at rest without the user exerting force on the pull pin 210). Optionally, the pull pin distal flange 226 is configured to move from the expanded state to the collapsed state when a user pulls on the pull pin handle 218, which allows the pull pin distal flange 226 to flex due to slots 232. Alternatively or in addition, the pull pin distal flange 226 may have a pull pin distal flange height 228 generally parallel to the height of the bottom lateral extension holes (again only 215 is labelled), and in the pull pin distal flange expanded state, the pull pin distal flange height 228 is greater than the height of the front tab and rear tab bottom lateral extension holes 215 (as best seen in FIGS. 19 and 20), and in the pull pin distal flange collapsed state, the pull pin distal flange height 228 is less than the height of the holes in the front tab and rear tab bottom lateral extension holes 215 so that the pull pin 210 may be removed from the front tab and rear tab bottom lateral extension holes 215. (If the front tab and rear tab bottom lateral extension holes 215 are not the same size, the pull pin distal flange 226 need only be bigger than the distal-most of the front tab and rear tab bottom lateral extension holes 215 in the pull pin distal flange expanded state).

Figure 17:
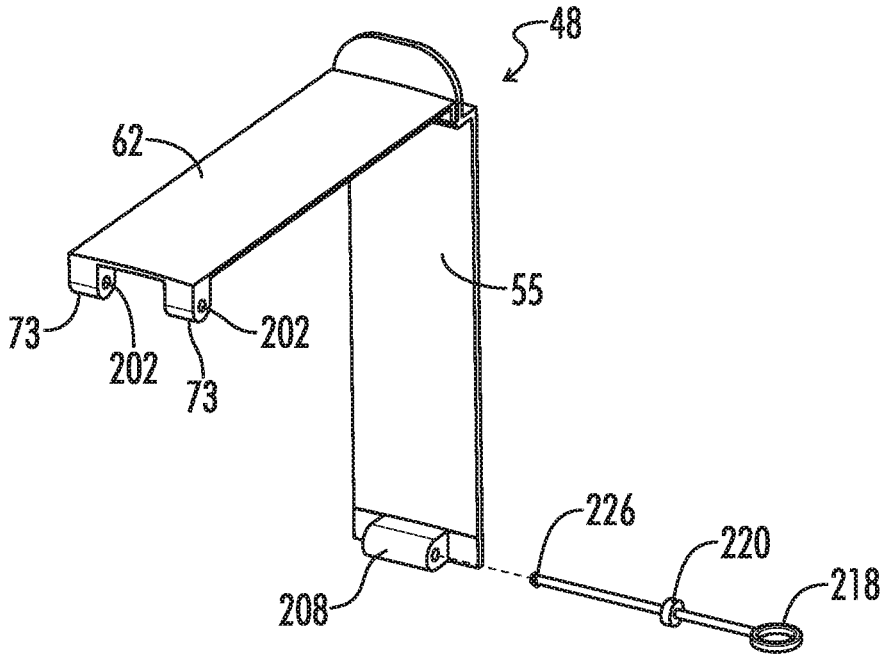
FIG. 17 illustrates a front perspective view of the band of the banded cutlery system of FIG. 15.
Figure 18:
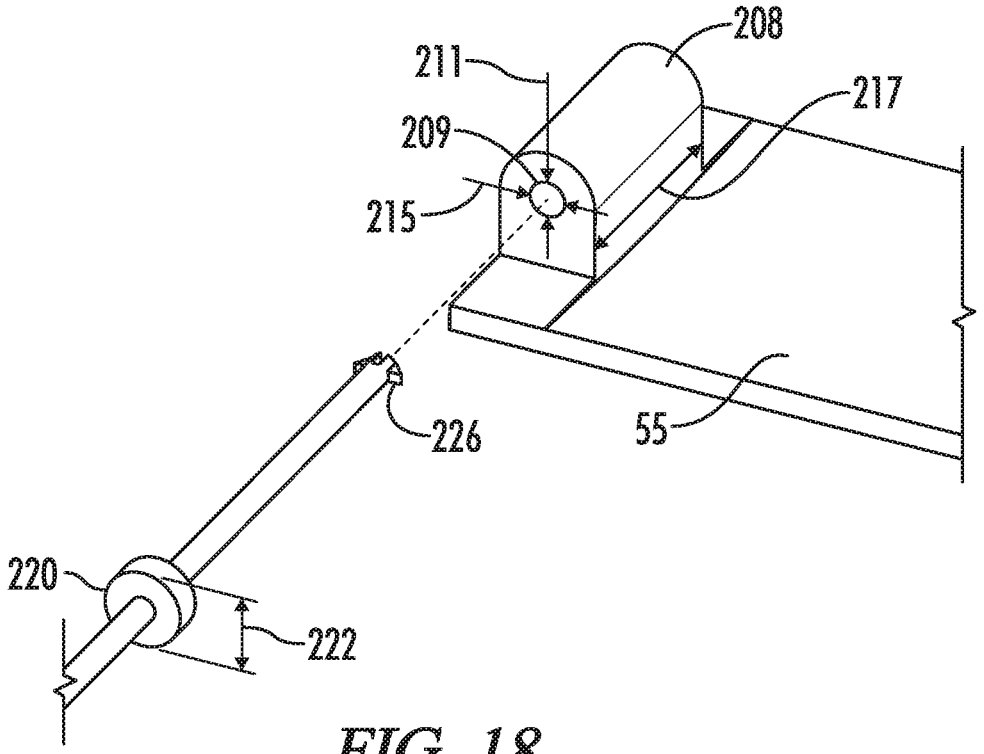
FIG. 18 illustrates a close-up side perspective view of the pull pin and the rear tab of the band of FIG. 17.

Optionally, at least one of the front tab 62 and the rear tab 55 comprises two bottom lateral extensions, the pull pin 210 is inserted through the holes in all of the bottom lateral extensions 202 and 209 and the bottom lateral extensions 73 and 208 interlock. (For example, the front tab 62 may have two bottom lateral extensions 73, as best seen in FIG. 17, and the rear tab bottom lateral extension 208 may be located between the front tab bottom lateral extensions 73. Alternatively, the rear tab 55 may have two bottom lateral extensions 208 and the front tab 55 may have one bottom lateral extension 73). Optionally, the pull pin proximal flange 220 is generally cylindrical in shape. Optionally, the pull pin distal flange 226 is tapered.

Optionally, the front tab 62 is configured to pivot along the front tab/hinge pivot axis 85 and the rear tab 55 is configured to pivot along the rear tab hinge/pivot axis 100 when the user pulls the pull pin handle 218 proximally to remove the pull pin 210 from the front tab and rear tab bottom lateral extension holes 202 and 209.

Optionally, the banded cutlery system 10 is used in a method of loading a cutlery dispenser comprising the steps of: a) providing a cutlery dispenser; b) loading the banded cutlery system 10 into the cutlery dispenser; c) removing the pull pin 210 from the front tab and rear tab bottom lateral extension holes 202 and 209; d) pivoting the front tab 62 about the front tab hinge/pivot axis 85 and the rear tab 55 about the rear tab hinge pivot axis 100; and e) removing the front tab 62 and the rear tab 55 without removing the cutlery stack 12 from the cutlery dispenser. (As used herein the term "cutlery dispenser" refers to any device or component thereof that can be used to dispense cutlery, including cutlery dispensers such as the DIXIE SMARTSTOCK cutlery dispenser (Georgia-Pacific, Atlanta, Ga.) and the KLEENPAK cutlery dispenser cartridge (California; www.kleenpak.com).

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A banded cutlery system for loading a stack of cutlery into a cutlery dispenser comprising:

a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side comprising a cutlery piece front side contour, a rear side, a width extending from the front side to the rear side and generally parallel to the stack width, an eating portion, a handle extending from the eating portion, the handle comprising a handle end, and a piece length extending from the eating portion to the handle end and generally parallel to the stack length;

b) a band removably attached to the stack and comprising:

i) a front tab comprising a front tab bar comprising a front tab bar top located above the top of the stack, a front tab bar bottom located below the bottom of the stack, a front tab bar height extending from the front tab bar top to the front tab bar bottom, the front tab bar height generally parallel to the stack height, a front tab bar left side, a front tab bar right side, a front tab bar length extending from the front tab bar left side to the front tab bar right side and generally parallel to the stack length, the front tab bar extending along the stack height and confronting the front sides of the cutlery pieces as the front tab bar extends along the stack height, a front tab top lateral extension extending from the front tab bar generally perpendicular to the front tab bar height, and a front tab bottom lateral extension extending from the front tab bar generally perpendicular to the front tab bar height and located directly below the bottom of the stack, the bottom lateral extension supporting the bottom of the stack;

ii) a rear tab comprising a rear tab bar comprising a rear tab bar top located above the top of the stack, a rear tab bar bottom located below the bottom of the stack, a rear tab bar height extending from the rear tab bar top to the rear tab bar bottom, the rear tab bar height generally parallel to the stack height, the rear tab bar extending along the stack height and confronting the rear sides of the cutlery pieces as the rear tab bar extends along the stack height, and a rear tab top lateral extension extending from the rear tab bar generally perpendicular to the rear tab height and located directly above the top of the stack; and iii) a fastener removably connecting the front tab bottom lateral extension to the rear tab bar, wherein the front tab comprises a permanent front tab contour extending along the cutlery stack height and mating with at least a portion of the cutlery piece front side contour of each cutlery piece, said mating configured to prevent said cutlery pieces from moving in a direction parallel to the cutlery piece length and the front tab bar length, and further wherein the cutlery piece front side contours of the cutlery pieces are generally aligned along the stack height.

2. A banded cutlery system for loading a stack of cutlery into a cutlery dispenser comprising:

a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side, a rear side comprising a cutlery piece rear side contour, a width extending from the front side to the rear side and generally parallel to the stack width, an eating portion, a handle extending from the eating portion, the handle comprising a handle end, and a piece length extending from the eating portion to the handle end and generally parallel to the stack length;

b) a band removably attached to the stack and comprising:

i) a front tab comprising a front tab bar comprising a front tab bar top located above the top of the stack, a front tab bar bottom located below the bottom of the stack, a front tab bar height extending from the front tab bar top to the front tab bar bottom, the front tab bar height generally parallel to the stack height, a front tab bar left side, a front tab bar right side, a front tab bar length extending from the front tab bar left side to the front tab bar right side and generally parallel to the stack length, the front tab bar extending along the stack height and confronting the front sides of the cutlery pieces as the front tab bar extends along the stack height, a front tab top lateral extension extending from the front tab bar generally perpendicular to the front tab bar height, and a front tab bottom lateral extension extending from the front tab bar generally perpendicular to the front tab bar height and located directly below the bottom of the stack, the front tab bottom lateral extension supporting the bottom of the stack;

ii) a rear tab comprising a rear tab bar comprising a rear tab bar top located above the top of the stack, a rear tab bar bottom located below the bottom of the stack, a rear tab bar height extending from the rear tab bar top to the rear tab bar bottom, the rear tab bar height generally parallel to the stack height, the rear tab bar extending along the stack height and confronting the rear sides of the cutlery pieces as the rear tab bar extends along the stack height, and a rear tab top lateral extension extending from the rear tab bar generally perpendicular to the rear tab height and located directly above the top of the stack; and iii) a fastener removably connecting the front tab bottom lateral extension to the rear tab bar, wherein the rear tab comprises a permanent rear tab contour extending along the cutlery stack height and mating with at least a portion of the cutlery piece rear side contour of each cutlery piece, said mating configured to prevent said cutlery pieces from moving in a direction parallel to the cutlery piece length and the rear tab bar length, and further wherein the cutlery piece rear side contours of the cutlery pieces are generally aligned along the stack height.

3. The banded cutlery system of claim 2, wherein the cutlery piece rear side contour comprises a recess and the rear tab contour mates with the recess.

4. The banded cutlery system of claim 2, wherein the rear tab contour comprises a recess and the cutlery piece rear side contour mates with the recess.

5. The banded cutlery system of claim 2, wherein the rear tab contour comprises a groove and the cutlery piece rear side contour mates with the groove.

6. The banded cutlery system of claim 2, wherein the cutlery piece rear side contour is located in the handle of each cutlery piece.

7. The banded cutlery system of claim 6 wherein the cutlery piece rear side contour is located in a segment of the handles of the cutlery pieces, the segment having a variable width, and further wherein the segment comprises a proximal end located a first distance from the eating portion, a distal end located a second distance from the eating portion, the second distance greater than the first distance, and an intermediate portion located between the proximal end and the distal end and further wherein the segment width gradually increases from the proximal end to the intermediate portion and further wherein the segment width gradually decreases from the intermediate portion to the distal end.

8. The banded cutlery system of claim 6 wherein the cutlery piece rear side contour is located in a segment of the handles of the cutlery pieces, the segment having a variable width, and further wherein the segment comprises a proximal end located a first distance from the eating portion, a distal end located a second distance from the eating portion, the second distance greater than the first distance, and an intermediate portion located between the proximal end and the distal end and further wherein the segment width gradually decreases from the proximal end to the intermediate portion and further wherein the segment width gradually increases from the intermediate portion to the distal end.

9. The banded cutlery system of claim 2 wherein the front side of each cutlery piece comprises a cutlery piece front side contour, wherein the front tab comprises a front tab contour extending along the cutlery stack height and mating with at least a portion of the cutlery piece front side contour, said mating configured to prevent said cutlery pieces from moving in a direction parallel to the cutlery piece length and the front tab length, and further wherein the cutlery piece front side contours of the cutlery pieces are generally aligned along the stack height.

10. The banded cutlery system of claim 9 wherein the cutlery piece front side contour is a mirror image of the cutlery piece rear side contour and the cutlery pieces are generally symmetrical about a longitudinal axis of the cutlery pieces.

11. The banded cutlery system of claim 2 wherein the front tab is configured to pivot along a front tab pivot axis to an unlocked position in which the front tab bottom lateral extension is disconnected from the rear tab bar, in which the front tab bottom lateral extension is not below the stack, in which the front tab bottom lateral extension is in front of the stack and further in which the front tab bar height is not parallel to the stack height.

12. The banded cutlery system of claim 11, wherein the system further comprises a recess opposite the at least one pivot axis and facing the stack top.

13. The banded cutlery system of claim 12 wherein the at least one pivot axis is a hinge.

14. The banded cutlery system of claim 2 further comprising a handle tab comprising a handle tab base connected to the front tab and the rear tab and a handle tab apex.

15. The banded cutlery system of claim 2, wherein the rear tab is configured to pivot along a rear tab pivot axis to an unlocked position in which the front tab bottom lateral extension is disconnected from the rear tab bar, and further in which the rear tab bar height is not parallel to the stack height.

16. The banded cutlery system of claim 2, wherein the fastener comprises a prong located in the front tab bottom lateral extension and a hole in the rear tab bar configured to removably receive the prong.

17. The banded cutlery system of claim 2, wherein the front tab bar bottom extends below the front tab bar bottom lateral extension and below the bottom of the stack.

18. The banded cutlery system of claim 2 wherein the band is plastic.

* * * * *